US005502422A

United States Patent [19]

Newell et al.

[11] Patent Number: 5,502,422

[45] Date of Patent: Mar. 26, 1996

[54] FILTER WITH AN ADJUSTABLE SHUNT ZERO

[75] Inventors: Michael Newell, Placitas; Raymond Sokola; David Heine, both of Albuquerque, all of N.M.

[73] Assignee: Motorola, Inc., Schaumburg, Ill.

[21] Appl. No.: 289,816

[22] Filed: Aug. 12, 1994

[51] Int. Cl.[6] ..... H01P 1/205

[52] U.S. Cl. ..... 333/207; 333/202

[58] Field of Search ..... 333/202, 204, 333/205, 206, 207, 174

[56] References Cited

U.S. PATENT DOCUMENTS 4,835,499 5/1989 Pickett ..... 333/205

5,227,748 7/1993 Sroka ..... 333/207

FOREIGN PATENT DOCUMENTS 9013943 11/1990 WIPO .

*Primary Examiner*—Benny Lee
*Assistant Examiner*—David H. Vu
*Attorney, Agent, or Firm*—Gary J. Cunningham

[57] ABSTRACT

A filter (102) with an adjustable shunt zero. The filter (102) has a predetermined passband and stopband, and an input (104) and an output (106), and a variable reactance element (108) for adjusting the stopband frequency of maximum attenuation, also defined as a shunt zero, coupled to at least one of the input (104) and the output (106) of the filter (102), whereby the shunt zero is adjustable over a range of frequencies.

16 Claims, 2 Drawing Sheets

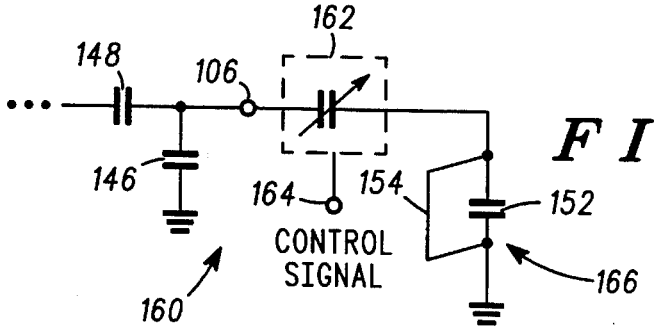
FIG. 4
FIG. 5
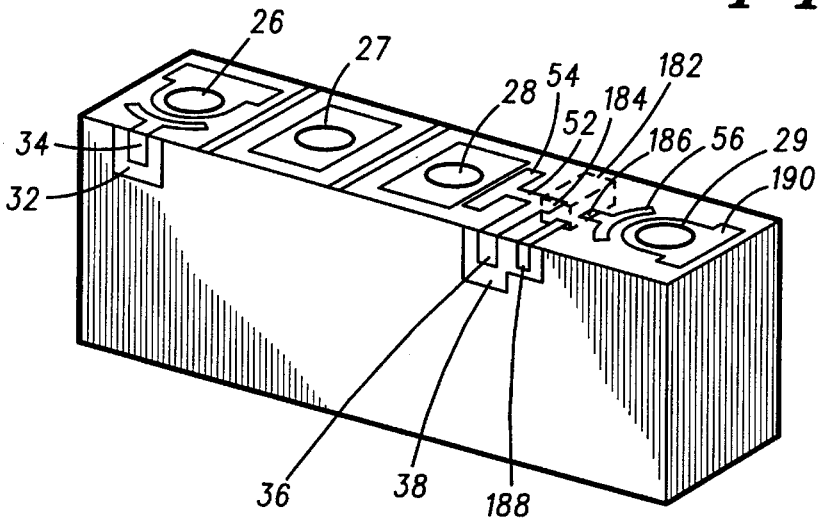
FIG. 6
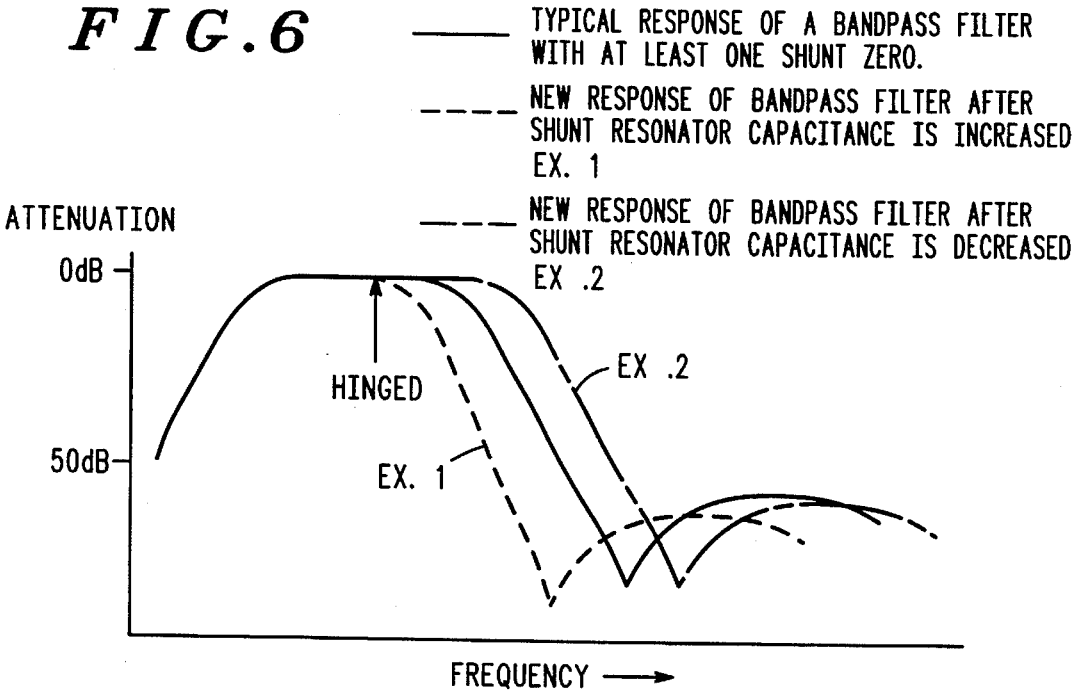

FILTER WITH AN ADJUSTABLE SHUNT ZERO

FIELD OF THE INVENTION

This invention generally relates to filters, and in particular, to a filter with an adjustable shunt zero.

BACKGROUND OF THE INVENTION

Filters are known to provide attenuation of signals having frequencies outside of a particular frequency range and little attenuation to signals having frequencies within the particular frequency range of interest. As is also known, these filters may be fabricated from ceramic materials having one or more resonators formed therein. A ceramic filter may be constructed to provide a lowpass filter, bandpass filter or a highpass filter, for example.

For bandpass filters, the bandpass area is centered at a particular frequency and has a relatively narrow bandpass region, where little attenuation is applied to the signals. While this type of bandpass filter may work well in some applications, it may not work well when a wider bandpass region is needed or special circumstances or characteristics are required.

Block filters typically use an electroded pattern on an outer (top) surface of the ungrounded end of a combline design. This pattern serves to load and shorten resonators of a combline filter. The pattern helps define coupling between resonators, and can define frequencies of transmission zeros.

These top metallization patterns are typically screen printed on the ceramic block. Many block filters include chamfered resonator through-hole designs to facilitate this process by having the loading and coupling capacitances defined within the block itself, for manufacturing purposes. The top chamfers help define the intercell couplings and likewise define the location of the transmission zero in the filter response. This type of design typically gives a response with a low side zero. To achieve a high side transmission zero response, chamfer through-holes are placed in the grounded end (bottom) of ceramic block filters, for example. Thus, a high zero response ceramic filter would typically have chamfers at both ends of the dielectric block. A double chamfer filter can be difficult to manufacture because of the tooling requirements and precise tolerances.

A filter which can be easily manufactured to manipulate and adjust the frequency response, preferably with a frequency adjustable shunt zero, to attenuate unwanted signals, could improve the performance of a filter and would be considered an improvement in filters, and particularly ceramic filters.

In duplexed telecommunications equipment, such as cellular telephones, two frequency ranges are normally allocated, one for transmitting and one for receiving. Each of these frequency ranges is subdivided into many smaller frequency ranges known as channels, as shown in FIG. 1. Bandpass filters in this equipment should be made to pass (with minimal attenuation) the entire transmit or receive frequency range, and attenuate the entire receive or transmit frequency range, respectively, even though the device will be using only one channel in each range at any given time. These filters must necessarily be larger than a filter with an equivalent performance, which operates over only a few channels.

A bandwidth of a filter can be designed for specific passband requirements. Typically, the tighter the passband, the lower the insertion loss, which is an important electrical parameter. However, a wider bandwidth reduces the filter's ability to attenuate unwanted frequencies, typically referred to as the rejection frequencies. The addition of a shunt zero in the transfer function at the frequency of the unwanted signal, could effectively improve the performance of a filter, as detailed below.

A mass-producable, dynamically tunable (or adjustable) filter which can modify the frequency response by attenuating unwanted signals, could improve the desired performance of a filter and would be considered an improvement in filters.

BRIEF DESCRIPTION OF THE DRAWINGS

FIG. 4 is a partial equivalent circuit of an alternate embodiment of the present invention, in accordance with the present invention.

FIG. 5 is an enlarged, perspective view of a ceramic filter with an adjustable shunt zero, as shown in FIG. 4, in accordance with the present invention.

FIG. 6 shows a frequency response of the filter shown in FIGS. 2 and 3, in accordance with the present invention.

DETAILED DESCRIPTION OF THE PREFERRED EMBODIMENT

Figure 1:
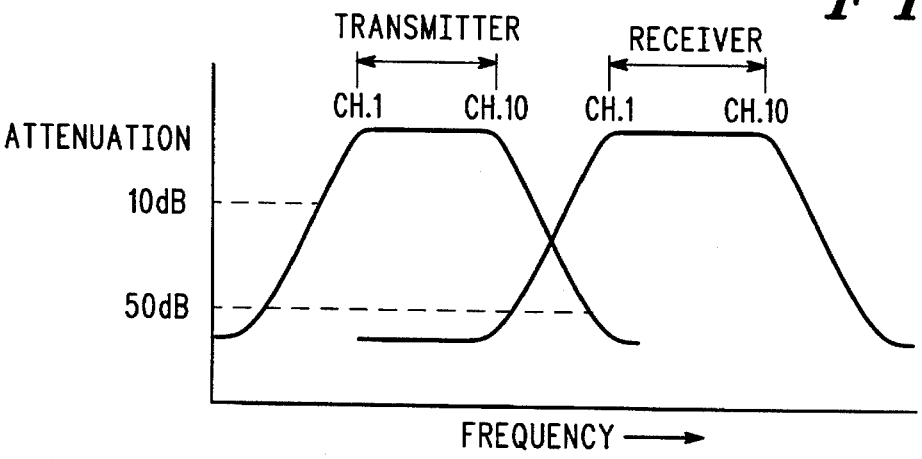
FIG. 1 is a typical frequency response for use in connection with communication devices generally, and specifically in connection with cellular telephones and the like, showing a transmit passband and a receive passband.
Figure 2:
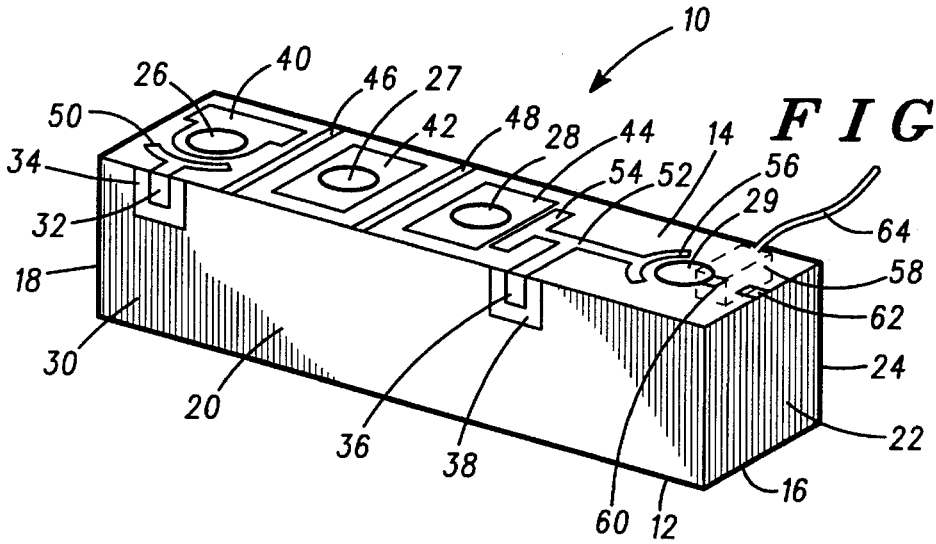
FIG. 2 is an enlarged, perspective view of a ceramic filter with an adjustable shunt zero, in accordance with the present invention.
Figure 3:
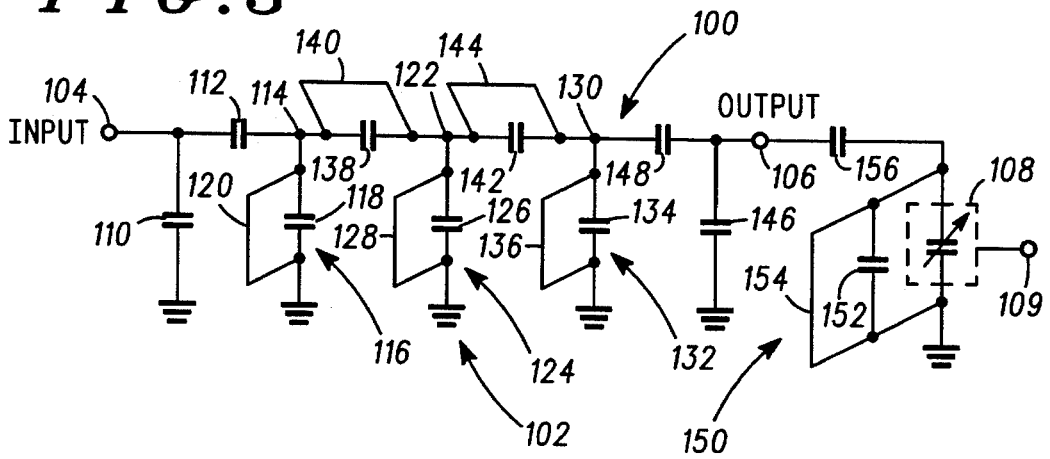
FIG. 3 is an equivalent circuit diagram of the filter shown in FIG. 2, in accordance with the present invention.

In FIGS. 2 and 3, a filter 10 with an adjustable shunt zero is shown. The frequency response of this filter can be dynamically adjusted, as is shown in FIG. 6. More particularly, FIG. 6 shows a passband for passing a desired frequency and a stopband or transmission zero on a high side of the passband, which is dynamically adjustable.

In more detail, the filter 10 can include a ceramic filter 12 comprising a block of dielectric material, and further includes a top 14, bottom 16, left side 18, front side 20, right side 22, and rear side 24. The ceramic filter 12 has a plurality of through-holes extending from the top to the bottom surfaces 14 to 16, defining resonators. The through-holes include a first, second, third and fourth through-hole 26, 27, 28 and 29, respectively which are substantially coated with a conductive material, and each is connected to the metallization on the bottom 16. The surfaces 16, 18, 20, 22 and 24, are substantially covered with a conductive material defining a metallized exterior layer, with the exception that the top surface 14 is substantially uncoated comprising the dielectric material. Additionally, a portion of the front side 20 is substantially uncoated comprising the dielectric material defining uncoated areas 34 and 38, surrounding input-output pads 32 and 36, respectively.

On the top surface 14, first, second and third metallization patterns 40, 42 and 44, are connected to the metallization in the first, second and third through-holes 26, 27 and 28, respectively, to provide capacitive loading of quarter-wave resonators formed by the through-holes and the metallization. Also on the top surface 14 are metallized lines 46 and 48 connecting the front 20 and rear sides 24. This structure positively influences the electro-magnetic coupling between the resonators formed from the through-holes 26 and 27, and 27 and 28, respectively.

The top surface 14 further includes a top section 50 of the first pad 32 and a top section 52 of the second pad 36, having a left section 54 and a right section 56.

The top section 50 provides capacitive coupling between the input/output pad 32 and the resonator formed from through-hole 26. The top section 52 electrically connects top sections 54 and 56 to the second pad 36. The left section 54 provides capacitive coupling between the pad 36 and the resonator formed from through-hole 28. And, likewise the right section 56 provides capacitive coupling between the pad 36 and the resonator formed from through-hole 29.

A variable reactance element 58 is shown mounted on the top surface 14 of the ceramic filter 12, and includes a first connection 60 connected to the fourth through-hole 29, a second connection 62 connected to the right side 22 and a control signal input 64.

The filter 10 and 100 in FIGS. 2 and 3, include a variable reactance element 58 and 108, which can be used to dynamically adjust the resonant frequency of the resonator comprised of through-hole 29 and the metallization, variable reactance element 58 and 108, and metallization patterns 56, 60 and 62 (154, 152 and 108), respectively. This resonator can be designed to operate at a frequency above or below the frequency band of minimum attenuation (passband) of the filter. It provides a deep notch (shunt zero) of increased attenuation whose center frequency can be dynamically adjusted using a control signal to the variable reactance element by adjusting the control signal to input 64 or 109, in FIGS. 2 and 3.

In a preferred embodiment, a high side shunt zero is adjustable for attenuating unwanted signals above the passband, for the above reasons. It should be understood by those skilled in the art, that in certain applications an adjustable low side shunt zero could be advantageous, and is considered within the scope of the invention.

An equivalent circuit diagram of a filter with an adjustable shunt zero is shown as item 100 in FIG. 3. The diagram 100 includes a filter 102 which includes an input node 104 and an output node 106 connected to a variable reactance element 108 for adjusting the stopband frequency of maximum attenuation or shunt zero, coupled to at least one of the input and the output nodes 104 and 106 of the filter 102, whereby the shunt zero is adjustable over a range of frequencies. In a preferred embodiment, the filter (10 or) 102 has a predetermined passband and stopband, substantially as shown in FIG. 6.

In more detail, the variable reactance element 108 includes a control signal input 109, for varying the reactance of the variable reactance element 108. The variable reactance element 108 can vary widely. In a preferred embodiment, the variable reactance element comprises a voltage variable compacitor because it has several desirable characteristics, such as a high quality factor or "Q", wide capacitance range, narrow control voltage range and small size.

Connected between the input node 104 and ground is a first input capacitor 110. A second input capacitor 112 is coupled between the input node 104 and first resonator node 114. A first resonator 116 is shown coupled between the first resonator node 114 and ground which includes capacitive and inductive elements 118 and 120, respectively.

Similarly, second and third resonator nodes 122 and 130 are shown. A second resonator 124 is shown being coupled between the second resonator node 122 and ground and includes a capacitive element 126 and an inductive element 128. And likewise, a third resonator 132 includes a capacitive element 134 and an inductive element 136, coupled in parallel between the third resonator node 130 and ground.

Also shown in FIG. 3, between the first and second resonator nodes 114 and 122, are capacitive and inductive elements 138 and 140 in parallel. Similarly, between the second and third resonator nodes 122 and 130 are capacitive and inductive elements 142 and 144 in parallel. The inductive elements 140 and 144, represent the electro-magnetic coupling between resonators 116 and 124, and 124 and 132, respectively, which exist due to the close proximity of the through-holes 26 and 27, and 27 and 28, respectively. Capacitive elements 138 and 142 represent the capacitances formed between metallization pads 40 and 42, and 42 and 44, respectively. The metallized lines or patterns 46 and 48 in FIG. 2, positively modify elements 138 and 142 to produce the desired frequency response.

A first output capacitor 146 is coupled between the output node 106 and ground and a second output capacitor 148 is connected between the output node 106 and the third resonator node 130. A third output capacitor 156 is connected between the output node 106 and the parallel resonant circuit 150. The third output capacitor 156 couples the output node 106 to the variable reactance element 108. The capacitor 146 is defined as the capacitance between the output (second) pad 36 and the metallized layer 30 on the front side 20, in FIG. 2. The capacitor 148 is the capacitance between the left section 54 and third metallization pattern 44, on the top surface 14 in FIG. 2. And, the capacitor 156 is the capacitance between the right section 56 and the metallization in the through-hole 29. The values of these capacitances are chosen to provide the desired frequency response.

Referring to FIG. 3, connected between the output node 106 and ground is a parallel resonant circuit (or device) 150 which includes a capacitive element 152 and an inductive element 154 in parallel. The variable reactance element 108 with the control signal input 109 provides a variable capacitance across the parallel resonant circuit 150. The element 108 can provide a variable frequency response, substantially dynamically adjustable as shown in FIG. 6. For example, a typical response of a bandpass filter with at least one shunt zero is shown in solid line (frequency response), in FIG. 6. In the event that the control signal input 109 is suitably adjusted, to increase the capacitance of variable reactance element 108, a new response, shown in dashed line as Example 1 can be attained. In the event that the capacitance is decreased, the frequency response (or shunt zero) can be moved to the right of the typical response in FIG. 6, shown as Example 2.

The ability to dynamically adjust the shunt zero frequency (or frequency of maximum attenuation), can result in substantial weight savings and size minimization, by allowing the use of a physically smaller filter. Additionally, it can be advantageous to have the ability to precisely place the transmission zero at a desired location. If the maximum attenuation provided by the shunt zero were required over a large bandwidth, a larger filter with more resonators would be necessary. Since most present telecommunications equipment operates on only one channel at any given time, a smaller filter with an adjustable shunt zero would be useful, and the frequency of the maximum attenuation (transmission zero) could be changed as the channel in use changes, thereby providing ample attenuation at the desired frequency of operation.

Alternatively, the variable reactance element 108 can be coupled between the input node 104 and ground, to attain the frequency response similar to that shown in FIG. 6. Connecting a variable reactance element 108 on the input is substantially similar to doing the same on the a desired output.

Alternatively, a variable reactance element could be connected to the input node and a second variable reactance element could be connected to the output node 106. This could result in a greater maximum attenuation which is dynamically frequency adjustable or in two points of maximum attenuation which are independently adjustable, if desired.

In any event, a preferred embodiment is where the variable reactance element 108 is coupled between the output node 106 via capacitor 156 in FIG. 3, and ground, so that a small or portable filter with a stable input phase at the input port (node) can be attained, and which has a minimal effect on the output port (node) reflection coefficient as the reactance of element 108 is adjusted.

In more detail, in a preferred embodiment, the filter 102 includes a parallel resonant circuit 150 and the variable reactance element 108 in parallel, connected between the capacitor 156 and ground, for the above reasons.

The variable reactance element 108 can vary widely. For example, the variable reactance element 108 can include a varactor, variable voltage capacitor and the like. In a preferred embodiment, the variable reactance element 108 includes a variable voltage capacitor (VVC) for its high quality factor (Q), small size, large capacitance range and small input signal requirements. A preferred VVC, includes a three-terminal semi-conductor device which exhibits capacitance ranges between a minimum and maximum value between two of its terminals. The value is a function of a voltage applied to the third terminal.

Referring to FIG. 4, a partial schematic diagram of an alternate embodiment of the filter 10 of this invention is shown, as item 160. In this embodiment, a variable reactance element 162 is shown with a control signal input 164 and a resonant circuit 166 in series, between output node 106 and ground.

In one embodiment, the parallel resonant circuit 166 in FIG. 4, includes a variable voltage capacitor 152, for the reasons detailed herein.

In FIG. 5, an alternate embodiment of a filter 180 with an adjustable shunt zero is shown, corresponding to the schematic diagram shown in FIG. 4. This embodiment is substantially similar to that described with respect to FIG. 2 except for the differences in structure shown in FIGS. 4 and 5.

In FIG. 5, a variable reactance element 182 is shown (in partial phantom so as to illustrate the metallization patterns in proximity thereto), coupled between the output node 106 and the resonant circuit 166 in FIG. 4. More particularly, the variable reactance element 182 includes a first connection 184 directly coupled to the top section 52 of the second pad 36, and a second connection 186 coupled to the right section 56. A control signal input pad 188 connected to the variable reactance element 182 is also shown in FIG. 5, to receive a signal, to adjust the shunt zero. A metallization pattern 190 is also shown connected to the fourth through-hole 29 to provide a desired frequency response. In the embodiment shown in FIGS. 4 and 5, it should be noted that the top section 52 is discontinuous, or does not connect the left and right section 54 and 56. Connected between the left and right sections 54 and 56 is the variable reactance element 182.

This embodiment will behave slightly different from that shown in FIG. 3, because the variable reactance element is connected directly to the output node 106. As the reactance value changes, the impedance at node 106 will vary which may (or may not) be desirable, depending upon the external device or circuit which is connected to the filter 102 at the output node 106. The filter shown in FIGS. 2–5, include three tuned resonators. Those skilled in the art should appreciate that the filter 12 could include two tuned resonators, such as the first and second resonators 116 and 124 grounded at one end and electrically coupled as shown in FIG. 3 at the other, or more than three tuned resonators, depending on the desired frequency response and application.

However, a three resonator structure as shown in FIG. 2 is a preferred embodiment, for the reasons provided herein.

The electrical couplings between the first and second nodes 114 and 122, and the second and third nodes 122 and 130, are accomplished by suitable placement of the resonators and metallization patterns 40, 42 and 44, as shown in FIG. 2 and previously discussed. Alternatively, the electrical coupling can be provided by a discreet network, if desired.

In one embodiment, the output node 106 is connected to a tuned resonator, such as resonant circuit 166 in FIG. 4, through the variable reactance element 162. More particularly, these elements are in series between output node 106 and ground, for the reasons previously discussed.

In one embodiment, the input 104, the output 106 or both, of the filter 102 can be capacitively coupled to a variable reactance element, for modifying the desired frequency response.

Although the present invention has been described with reference to certain preferred embodiments, numerous modifications and variations can be made by those skilled in the art without departing from the novel spirit and scope of this invention.

What is claimed is:

1. A filter with an adjustable shunt zero, comprising:

(a) a filter having a predetermined passband defined by tuned resonators located between an input and an output, and stopband;

(b) a variable reactance element for adjusting the stopband frequency of local maximum attenuation in proximity to the passband, defined as a shunt zero, coupled to at least one of the input and output of the filter and to a parallel resonant circuit other than one of the tuned resonators, whereby the shunt zero is adjustable over a range of frequencies; and the variable reactance element includes a variable voltage capacitor and the parallel resonant circuit including an inductive element and a capacitive element, the variable voltage capacitor is connected to the input or the output of the filter and the parallel resonant circuit is coupled between the variable capacitor and ground.

2. The filter of claim 1, wherein the filter includes the parallel resonance circuit and the variable reactance element in parallel connected between the output and ground.

3. The filter of claim 1, wherein the variable reactance element includes a voltage variable capacitor including a control input.

4. The filter of claim 1, wherein the variable voltage capacitor is a varactor.

5. The filter of claim 1, wherein the parallel resonant circuit includes a variable capacitor.

6. The filter of claim 1, wherein the filter includes at least two tuned resonators grounded at one end and electrically coupled at the other.

7. The filter of claim 6, wherein the electrical coupling includes adjacent placement of the resonators to each other or a discreet network.

8. The filter of claim 1, wherein there are at least three tuned resonators grounded at one end and electrically coupled at the other.

9. The filter of claim 1, wherein the input and the output is each capacitively coupled to at least one tuned resonators.

10. The filter of claim 1, wherein the filter comprises a passive ceramic filter.

11. The filter of claim 1, wherein the output of the filter is connected to the parallel resonant circuit through the variable reactance element.

12. The filter of claim 1, wherein the output of the filter is connected to a tuned resonator through a variable capacitor.

13. The filter of claim 1, wherein the input, the output or both of the filter is capacitively coupled to the variable reactance element.

14. The filter of claim 1, wherein the output of the filter is connected to a parallel resonant circuit through a variable voltage capacitor.

15. A filter with an adjustable shunt zero, comprising:

a filter having a predetermined passband defined by at least two tuned resonators and stopband, and at least a first and second tuned resonator grounded at one end and inductively and capactively coupled at the other located between the input and the output;

a variable reactance element for adjusting the stopband frequency of maximum attentuation defined as a shunt zero, coupled to at least one of the input and the output of the filter and a parallel resonant circuit other than one of the first and the second tuned resonators, whereby the shunt zero is adjustable over a range of frequencies; and the variable reactance element includes a variable voltage capacitor and the parallel resonant circuit including an inductive element and a capacitive element, the variable voltage capacitor is connected to at least one of the input and the output of the filter and the parallel resonant circuit is coupled between the variable capacitor and ground.

16. The filter of claim 15, wherein the resonant circuit is in parallel with the variable reactance element and is coupled to the output via a capacitor.

* * * * *